US008011448B2

(12) United States Patent
Tulloch et al.

(10) Patent No.: US 8,011,448 B2
(45) Date of Patent: Sep. 6, 2011

(54) ROTARY STEERABLE TOOL

(75) Inventors: Rory McCrae Tulloch, Aberdeen (GB); Victor Laing Allan, Aberdeenshire (GB)

(73) Assignee: Sondex Limited, Yateley, Hampshire (GB)

( * ) Notice: Subject to any disclaimer, the term of this patent is extended or adjusted under 35 U.S.C. 154(b) by 114 days.

(21) Appl. No.: 12/302,523

(22) PCT Filed: May 30, 2007

(86) PCT No.: PCT/GB2007/001993

§ 371 (c)(1), (2), (4) Date: Nov. 26, 2008

(87) PCT Pub. No.: WO2007/138314

PCT Pub. Date: Dec. 6, 2007

(65) Prior Publication Data

US 2009/0173541 A1 Jul. 9, 2009

(30) Foreign Application Priority Data

Jun. 1, 2006 (GB) ..... 0610814.6
Mar. 13, 2007 (GB) ..... 0704756.6

(51) Int. Cl.
*E21B 7/08* (2006.01)
*E21B 7/04* (2006.01)
*E21B 7/06* (2006.01)
*E21B 47/02* (2006.01)

(52) U.S. Cl. ..... 175/45; 175/76; 175/61; 175/325.1

(58) Field of Classification Search ..... 175/26, 175/45, 51, 76, 61, 62, 325.1
See application file for complete search history.

(56) References Cited

U.S. PATENT DOCUMENTS 2,891,769 A * 6/1959 Page, Sr. et al. ..... 175/76
5,957,222 A * 9/1999 Webb et al. ..... 175/45
6,942,044 B2 * 9/2005 Moore et al. ..... 175/45
7,373,995 B2 * 5/2008 Hughes et al. ..... 175/61

FOREIGN PATENT DOCUMENTS

GB 2336171 A 10/1999
WO WO 01/04453 A 1/2001

* cited by examiner

*Primary Examiner* — Kenneth Thompson
*Assistant Examiner* — James G Sayre
(74) *Attorney, Agent, or Firm* — Global Patent Operation; Mark A. Conklin

(57) ABSTRACT

A rotary steerable tool (2) for use in a downhole drilling apparatus for adjusting the direction of drilling is disclosed. The tool comprises a tubular outer housing (20) and a row of steering pushers (24) slidably mounted to the housing for movement between an extended position, in which the steering pusher engages a wall of a borehole formed by the drilling apparatus, and a withdrawn position, in which the steering pushers do not engage the wall of the borehole. A tubular sleeve (4) is mounted inside the housing (20) to transmit rotary drive to a drilling bit. A pressure chamber (22) defined between the sleeve (4) and the housing (20) communicates with the steering pushers (24) to move the steering pushers (24) to the extended position. A piston (56) is slidably mounted in the sleeve (4) and is moved by means of changes in drilling fluid pressure between a first axial position, in which the interior of the sleeve (4) communicates directly with the pressure chamber (22) for directional drilling, and a second axial position, in which the interior of the sleeve (4) does not communicate directly with the pressure chamber (22) for straight drilling.

26 Claims, 12 Drawing Sheets

ROTARY STEERABLE TOOL

BACKGROUND OF THE INVENTION

The present invention relates to rotary steerable tools for incorporation into drilling apparatus, and relates particularly, but not exclusively, to such tools for use in the oil and gas well drilling industry.

Rotary steerable tools for incorporation into drilling apparatus for adjusting the direction of drilling of the drilling apparatus are known. Such tools are designed to be incorporated into a drill string and generally comprise a tubular outer housing for engaging the wall of a borehole formed by the drilling apparatus incorporating the tool and a hollow sleeve for transmitting drive from the surface to a drilling bit of the drilling apparatus. The sleeve defines a hollow passage for delivery of drilling fluid to the drill bit. A rotary steerable tool of this type is disclosed in WO 92/09783.

Preferred embodiments of the present invention seek to improve the design of rotary steerable tools.

BRIEF SUMMARY OF THE INVENTION

According to an aspect of the present invention, there is provided a rotary steerable tool adapted to be mounted in a downhole drilling apparatus for adjusting the direction of drilling of the apparatus, the rotary steerable tool comprising:— a tubular outer housing;

at least one steering pusher slidably mounted to the housing for movement between an extended position, in which the steering pusher engages a wall of a borehole formed by the drilling apparatus, and a withdrawn position, in which the steering pusher does not engage the wall of the borehole;

a tubular sleeve mounted inside the housing and adapted to be connected at first and second ends thereof to a drill string to transmit rotary drive to a drilling bit, wherein the sleeve defines a passage for passage of drilling fluid to the drilling bit;

a pressure chamber defined between the sleeve and the housing and communicating with at least one said steering pusher for enabling the steering pusher to move from the withdrawn to the extended position thereof; and a piston slidably mounted in the tubular sleeve and adapted to be moved by means of predetermined changes in drilling fluid pressure between a first axial position, in which the interior of the sleeve communicates directly with the pressure chamber to cause at least one said steering pusher to move to the extended position thereof to engage the wall of the borehole and adjust the direction of drilling of the drilling apparatus, and a second axial position, in which the interior of the sleeve does not communicate directly with the pressure chamber to prevent the or each said steering pusher from moving to the extended position thereof.

The tool may further comprise guide means, on one of said piston and said sleeve and defining a guide track, and guide follower means, on the other of said piston and said sleeve, wherein the guide track has at least one first guide portion, for engaging the guide follower means to retain the piston in the first axial position thereof when drilling fluid pressure is increased, and at least one second guide portion, for engaging the guide follower means to retain the piston in the second axial position thereof when drilling fluid pressure is increased, and first biasing means for urging the piston away from said first and second axial positions.

This provides the advantage of ensuring that the tool operates reliably even at high drilling fluid pressures.

The guide track may have at least one third guide portion arranged such that said first biasing means urges the piston into a third axial position thereof when drilling fluid pressure is reduced below a first predetermined level.

The first, second and third guide portions may be interconnected such that repeated application of drilling fluid pressure above a second predetermined level causes the piston to move alternately into the first and second axial positions thereof.

This provides the advantage of enabling the tool to be more reliably switched between the straight and directional drilling modes even in the case of widely varying drilling fluid pressure.

In a preferred embodiment, the guide track comprises at least one continuous slot around the circumference of the guide means, and said first; second and third guide portions extend from said slot, and said guide follower means comprises at least one guide pin for engaging said guide track such that axial movement of said piston between said first and said third axial positions, and between said second and said third axial positions, causes the or each pin to move along said slot.

The tool may further comprise a clutch for releasably coupling the housing to the sleeve for rotation therewith.

This provides the advantage of maximising the efficiency of the tool while in straight drilling mode by reducing the sliding friction of the tool in the borehole when in the straight drilling mode.

The clutch may comprise at least one clutch pin communicating with said pressure chamber and slidably mounted to said housing and axially displaced from the or each said steering pusher, wherein at least one said clutch pin is adapted to releasably engage said tubular sleeve.

This provides the advantage of automatically activating the clutch when the tool is switched from the straight drilling to the directional drilling mode. By providing clutch pins axially displaced from the steering pushers, this provides the advantage of making the steering pushers and clutch pins more responsive to increases of fluid pressure in the pressure chamber, while also making it easier to bias the steering pushers and clutch pins by means of return springs into their positions corresponding to the straight drilling mode.

The tool may further comprise second biasing means for biasing at least one said clutch pin into engagement with said sleeve.

The clutch may comprise a first hollow clutch member mounted to one of said housing and said tubular sleeve and having a plurality of protrusions arranged around an end surface thereof, a second clutch member mounted to the other of said housing and said sleeve and having a plurality of recesses for engaging said protrusions, and third biasing means for urging said first and second clutch members into an engaging position in which the protrusions and recesses engage each other to prevent relative rotation, of said housing and said sleeve, wherein said first and second clutch members are adapted to be disengaged from each other when the interior of the sleeve communicates directly with said pressure chamber.

This provides the advantage of making the clutch more robust.

The tool may further comprise flow restrictor means arranged at each end of said pressure chamber to restrict flow of fluid out of said pressure chamber to cause a pressure difference between the interior and the exterior of said pressure chamber.

This provides the advantage of enabling relatively less robust seals of the pressure chamber, which can suddenly fail and require the tool to be removed from the borehole for replacement of the seals, to be replaced by relatively more robust flow restrictors which act as leaking seals of the pressure chamber. These then further provide the advantage of acting as lubricated bearings in the directional drilling mode. The flow restrictor means also causes a pressure drop which can be detected at the surface, or by means of a suitable measurement while drilling (MWD) tool, to verify that the tool is in the directional drilling mode.

At least one said flow restrictor means may comprise an outer member and an inner member arranged inside said outer member such that fluid is caused to flow through a gap between said inner and outer members.

At least one said flow restrictor means may comprise a labyrinth assembly.

At least one of said first and second clutch members may be integral with said inner member and the other of said first and second clutch members may be integral with said outer member.

The tool may further comprise orientation indicating means for indicating the orientation of the housing relative to the tubular sleeve.

This provides the advantage of providing a continuous indication of the orientation of the housing relative to the sleeve which, in conjunction with a measurement while drilling (MWD) tool mounted on the drilling apparatus, enables the orientation of the steering pushers relative to the borehole to be determined while the drilling apparatus is in operation.

The orientation indicating means may comprise at least one magnet non-rotatably mounted relative to one of said housing and said sleeve, and at least one magnetic sensor non-rotatably mounted to the other of said housing and said sleeve.

At least one said magnetic sensor may be a Hall effect sensor.

The tool may further comprise a plurality of said magnets, wherein not all of said magnets are equiangularly spaced around the axis of rotation of said sleeve relative to said housing.

The tool may further comprise a plurality of said magnetic sensors, wherein not all of said sensors are equiangularly spaced around the axis of rotation of said sleeve relative to said housing.

At least one said steering pusher is adapted to be selectively disabled.

This provides the advantage of enabling the directional drilling behaviour of the tool to be easily modified.

At least one said steering pusher may be removable and slidably mounted in a passage in said housing by means of retention means and may be adapted to be outwardly removed from said passage by means of removal of said retention means.

This provides the advantage of enabling the steering pushers to be easily modified or replaced, or disabled, i.e. made inactive, or activated if previously disabled, at a drilling location.

The tool may further comprise third biasing means for urging at least one said steering pusher towards the withdrawn position.

The tool may further comprise at least one drag pusher adapted to protrude from said outer housing to engage the wall of the borehole.

The tool may further comprise fourth biasing means for urging at least one said drag pusher out of said housing.

According to another aspect of the present invention, there is provided a method of operating a rotary steerable tool as defined above, the method comprising applying drive to a drive shaft of a drilling apparatus incorporating the tool to drive a drilling bit of the drilling apparatus.

The method may further comprise the step of adjusting the direction of drilling of the drilling apparatus by moving said piston from said second axial position to said first axial position.

At least one said pusher piston may be used to apply a direct side force to the drilling bit.

At least one said pusher piston may be used to bend the tool with a stabiliser arranged between the tool and the drilling bit.

Preferred embodiments of the invention will now be described, by way of example only and not in any (imitative sense, with reference to the accompanying drawings, in which:—

DETAILED DESCRIPTION OF THE INVENTION

Figure 1A:
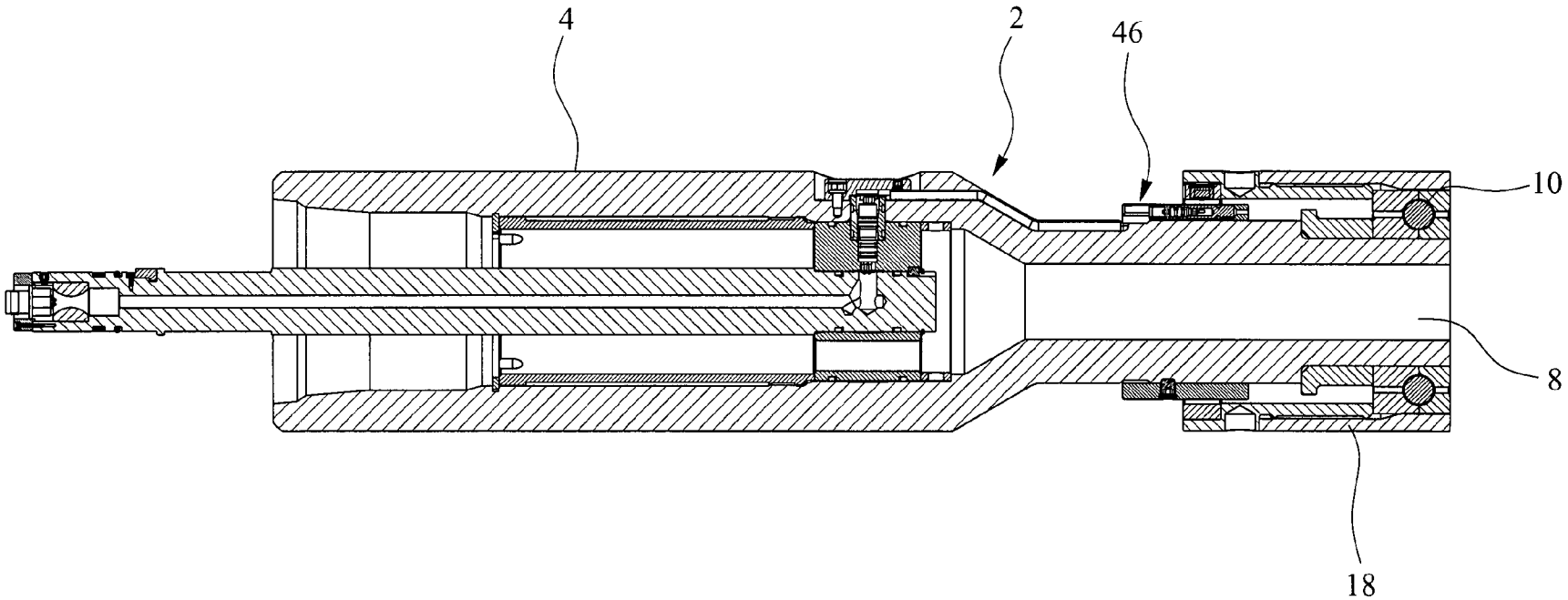
FIG. 1A is a side cross sectional view of a first part of a rotary steerable tool of a first embodiment of the present invention.
Figure 1B:
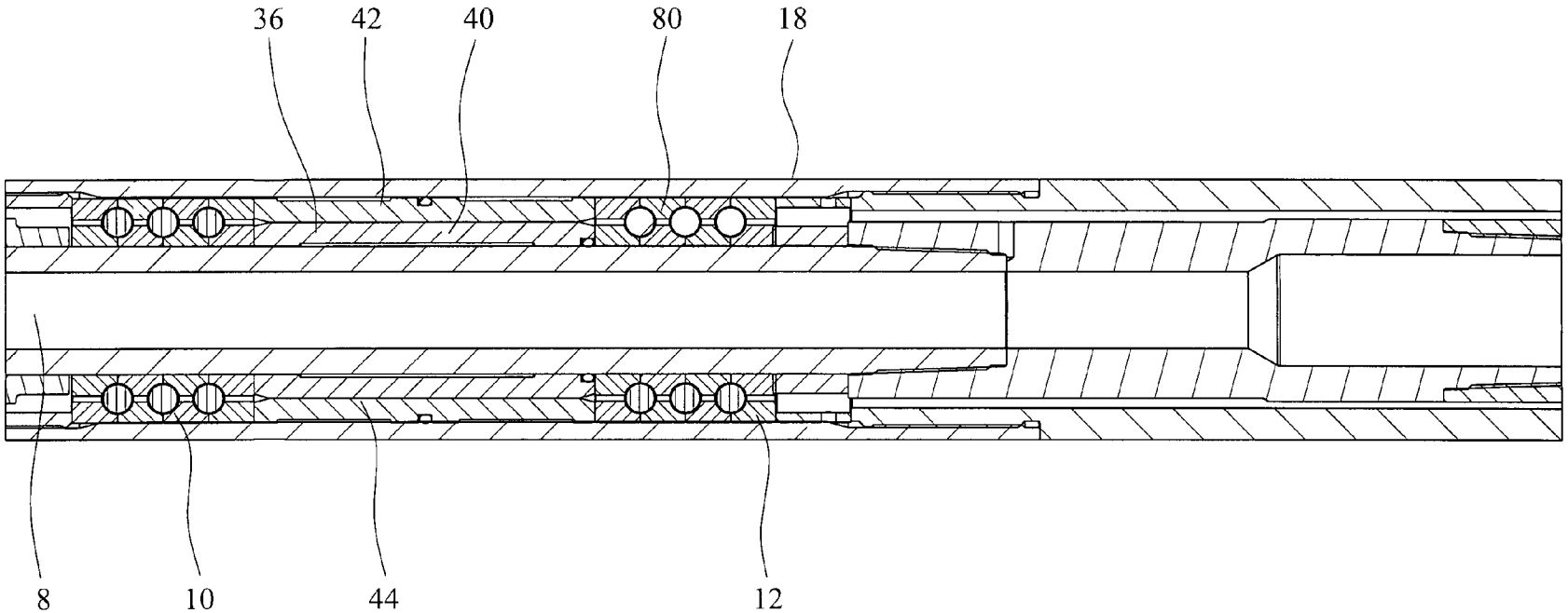
FIG. 1B is a side cross sectional view of a second part of the tool shown in FIG. 1A.

FIGS. 1A to 1G show a rotary steerable tool 2 of a first embodiment of the present invention. The tool 2 would be run in the drilling assembly near the bottom of the string. It could either be run a) right behind the drill-bit with a measurement while drilling (MWD) tool and a stabiliser above it between the MWD and the tool 2, or b) be run within the borehole assembly above the first string stabiliser 80 (preferably water-melon type) with a length of flexible pipe on either side of the stabilizer 80, and so act in a manner to tilt the bit rather than push the bit when activated. In addition, if the tool 2 is quite flexible, the tool could also be used to tilt the bit directly when run in the mode (a) described above and may require a stabiliser 80 (preferably water-melon type) between it and the drill-bit and may also need a short length of collar between the stabilizer 80 and the bit. If run with an MWD right above the tool, then either a string stabiliser 80 should be run right on top of the MWD or more preferably between the MWD and tool so that the tool assembly is reasonably well centralised in the well.

The tool 2 has a hollow sleeve 4 forming a drive shaft for incorporation into a drill string for transmitting torque from the surface of a borehole to a drill bit (not shown) connected to a lower end 6 of the drive shaft 4. The drive shaft 4 defines a hollow passage 8 for delivery of drilling fluid to the drill bit. The drive shaft 4 is rotatably mounted by means of upper bearings 10, 12 and lower bearings 14, 16 in an outer housing 18.

The outer housing 20 has a pressure chamber 22 in which a row of steering pushers 24 is slidably mounted. Each of the steering pushers 24 is slidably mounted in an aperture in the wall of the housing 20 such that entry of pressurised drilling fluid into the pressure chamber 22 applies an outward force onto inner faces 26 of the steering pushers 24 and urges the steering pushers 24 outwards into contact with the wall (not shown) of a borehole formed by the tool against the action of springs 28. The steering pushers 24 are arranged so that they can be removed outwardly from the apertures in the wall of the housing 20 by means of standard tools, which enables the steering pushers 24 to be easily replaced or adjusted at a drilling location without the need for removal of the tool 2 to a specialist workshop.

Figure 1C:
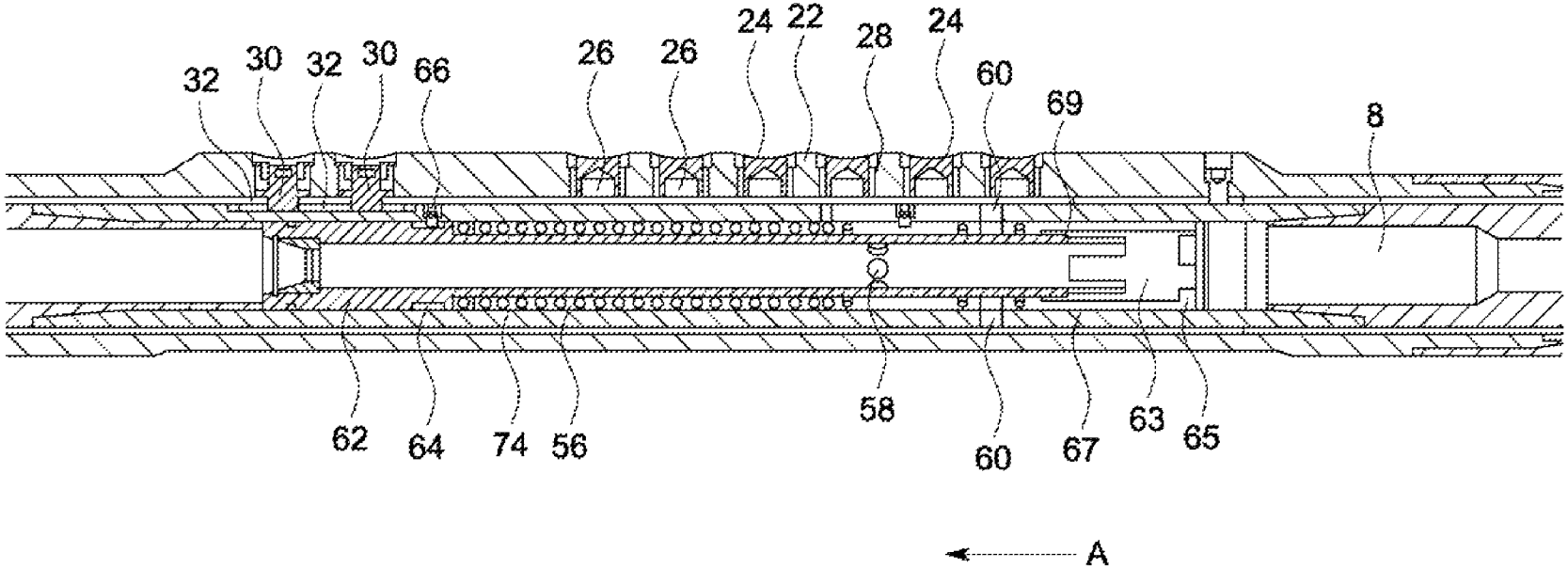
FIG. 1C is a side cross sectional view of a third part of the tool shown in FIG. 1A.
Figure 1D:
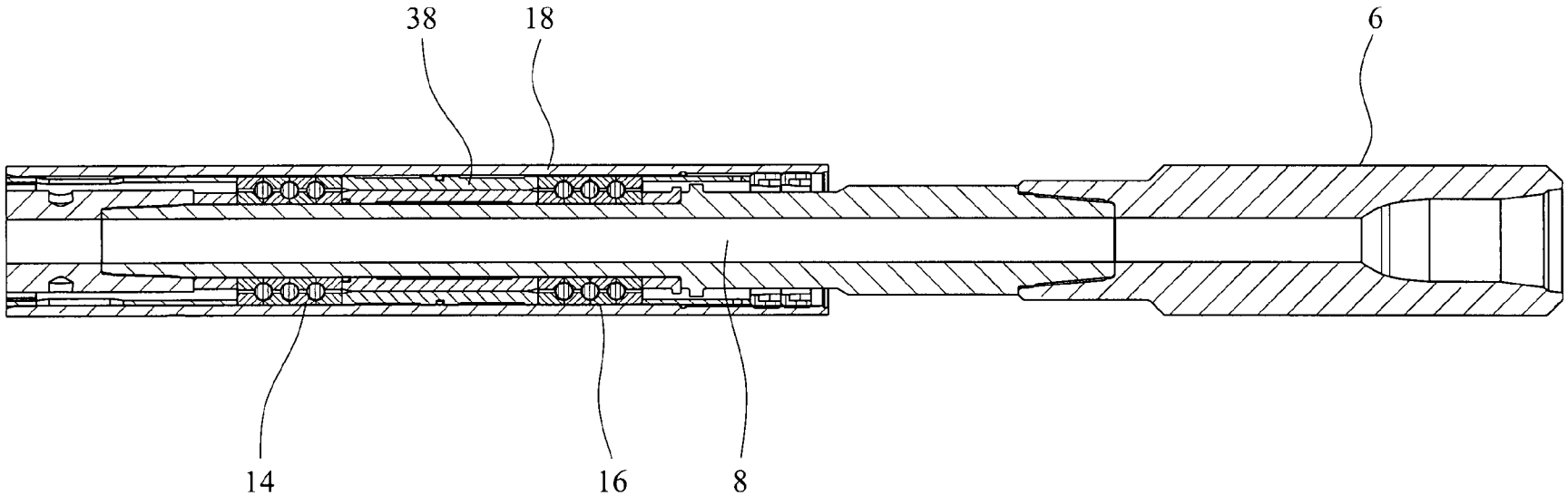
FIG. 1D is a side cross sectional view of a fourth part of the tool shown in FIG. 1A.
Figure 1E:
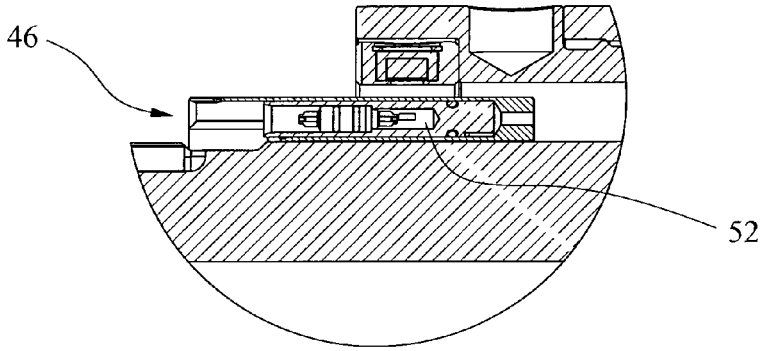
FIG. 1E is a detailed cross sectional view of a magnetic orientation sensor of the tool shown in FIG. 1A.
Figure 1F:
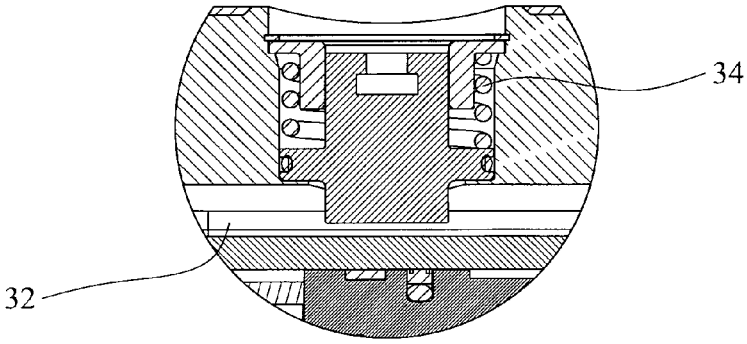
FIG. 1F is a detailed cross sectional view of a clutch of the tool part of FIG. 1C.
Figure 1G:
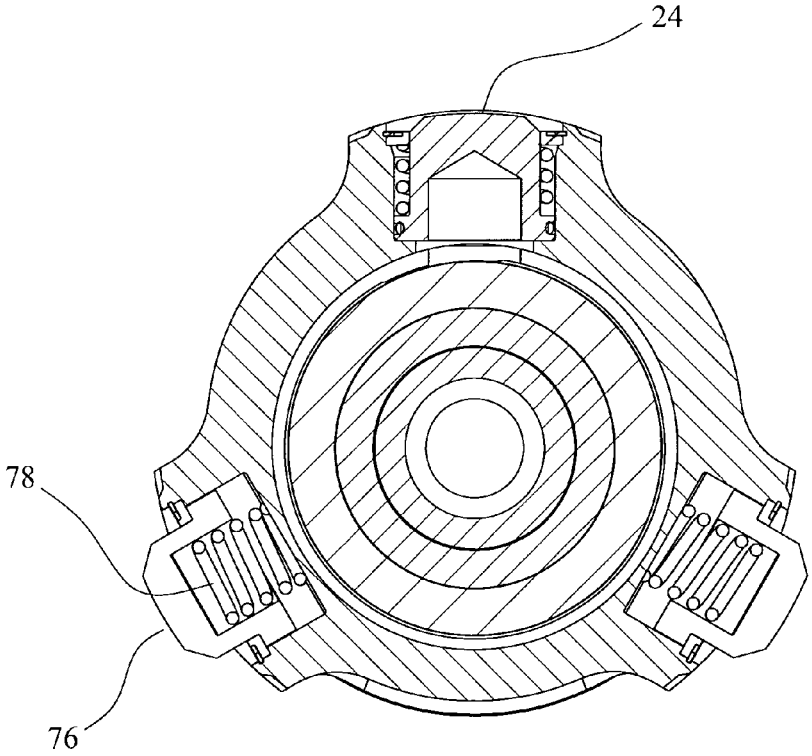
FIG. 1G is a detailed cross sectional view along the line X-X in FIG. 1C.

A pair of clutch pins 30 are also slidably mounted in the wall of the outer housing and are shown in more detail in FIG. 1F. The clutch pins 30 are urged into engagement with a slot 32 on the hollow sleeve 4 by means of springs 34 to prevent rotation of the housing relative 20 to the sleeve 4. Entry of pressurised fluid into the pressure chamber 22 causes the application of pressurised drilling fluid to the clutch pins 30, which causes the clutch pins 30 to disengage from the slot 32 to allow relative rotation between the sleeve 4, and the outer housing 20 when the tool 2 is in its directional drilling mode. The clutch pins 30 are axially spaced from the steering pushers 24, as a result of which the steering pushers 24 move outwards of the housing almost immediately when contacted by pressurised drilling fluid, because the steering pushers 24 need to move a smaller distance than in the case of earlier designs in which the steering pushers 24 and clutch pins 30 were integral with each other.

Figure 5:
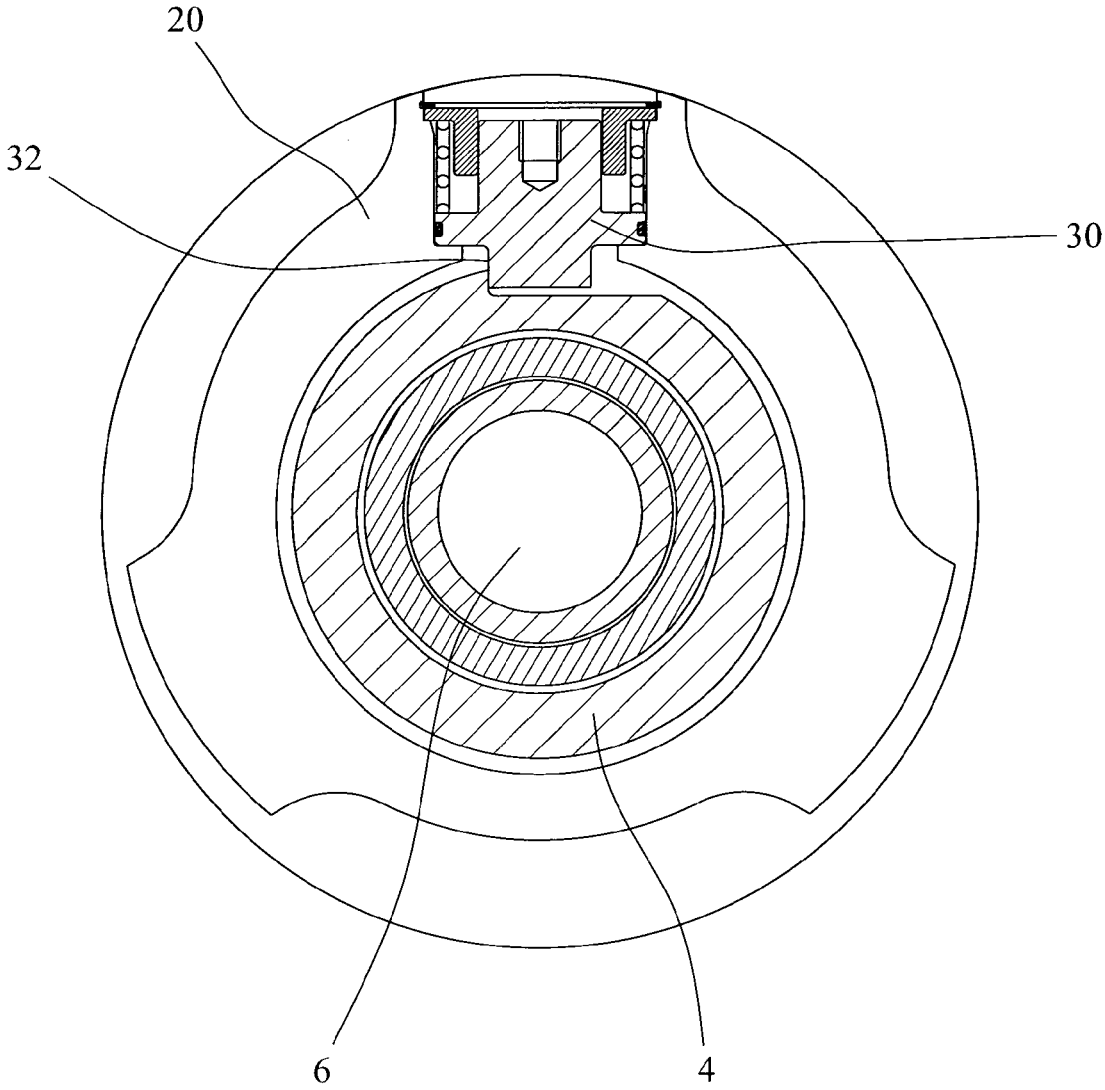
FIG. 5 is a detailed cross sectional view of a clutch pin and sleeve of the tool of FIGS. 1A to 1G.

FIG. 5 is a cross-section showing one of the two clutch pins 30 fully engaged with the drive-slot 32 in the sleeve 4. The slot 32 is milled away on one side to allow the clutch pin 30 to feed easily into the slot 32 and allow extra time for the pin 30 to move down into the slot 32 as the sleeve 4 is slowly rotated clockwise at surface with the tool off-bottom.

Flow restrictors 36, 38 are provided at the upper and lower ends respectively of the pressure chamber 22. The flow restrictors 36, 38 are generally of identical construction to each other, so only the upper flow restrictor 36 will be described in detail. The upper flow restrictor 36 consists of an inner cylindrical member 40 mounted to the sleeve 4 and an outer cylindrical member 42 mounted to the housing 20. The inner cylindrical member 40 is concentrically arranged inside the outer cylindrical member 42 such that a narrow gap 44 is formed between the members 40, 42 through which a small percentage of the fluid in the pressure chamber 22 (typically less than 5%) can leak. The flow restrictors 36, 38 therefore form leaking seals for the pressure chamber 22 and can replace less robust seals, as well as act as lubricated bearings when the housing 20 rotates relative to the sleeve 4 in the directional drilling mode. The flow restrictors 36, 38 also cause a pressure drop, which can be detected at the surface to verify that the tool is in its directional drilling mode. The bearings 10, 12, 14, 16 are placed either side of the flow restrictors 36, 38 to minimise the side thrust taken by the flow restrictors 36, 38 and so also decrease the torque drag on the outer assembly when the tool 2 is in the directional mode.

An orientation sensor 46 for indicating the orientation of the housing 20 relative to the sleeve 4 is shown in greater detail in FIG. 1E and comprises a series of equiangularly arranged permanent magnets 48 arranged around the housing 20, and a pair of irregularly spaced permanent magnets 50 arranged on the housing 20 adjacent to the steering pushers 24. A pair of Hall effect sensors 52 (only one of which is shown in FIG. 1E) is mounted on the sleeve 4 facing the magnets 48, 50 to provide a signal indicating the orientation of the outer housing 20, and therefore the steering pushers 24, relative to the sleeve 4. This signal can be used in conjunction with a MWD tool (not shown) on the drive shaft 4 to provide a continuous indication of the orientation of the housing 20 relative to the high side of the borehole, even while the tool 2 is in use in a drilling apparatus.

Figure 4A:
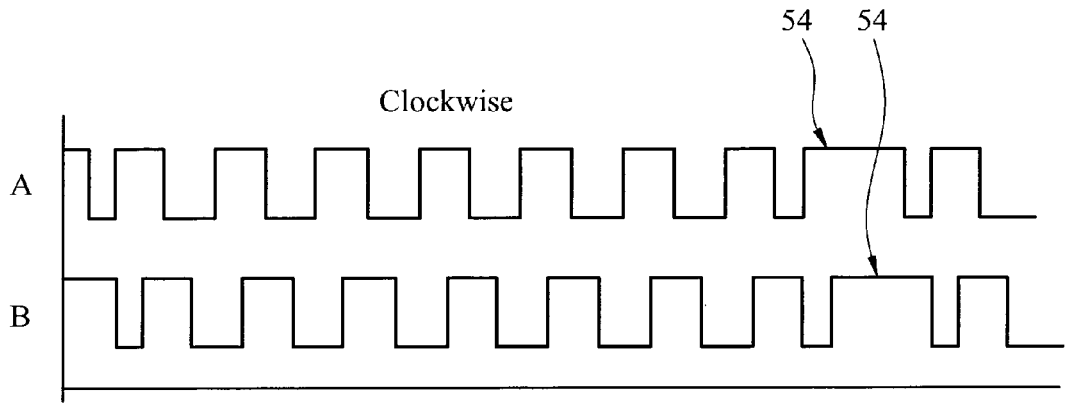
FIGS. 4A and 4B are pulse diagrams showing signals obtained from the orientation sensor of FIG. 3.
Figure 4B:
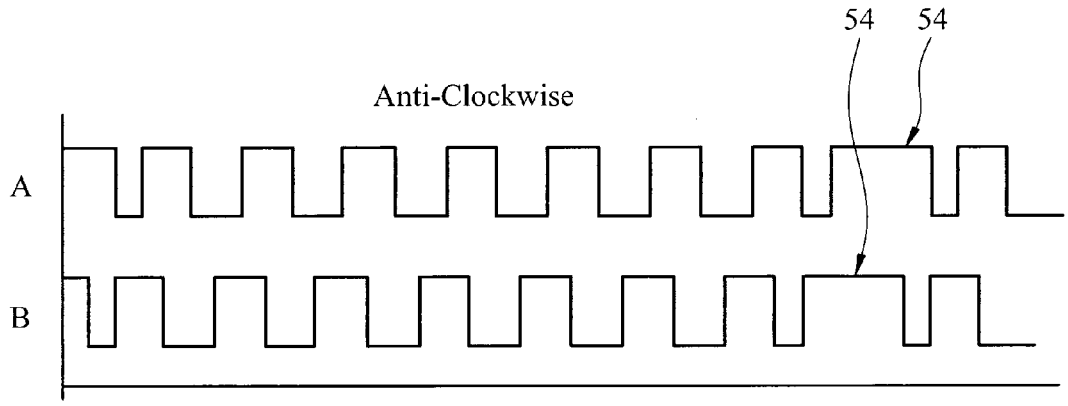

The signals obtained from the Hall effect sensors 52 are shown in greater detail in FIGS. 4A and 4B. Because of the irregular spacing of the permanent magnets 50, the upper pulse pattern obtained from each Hall effect sensor 52 will contain an irregular pulse 54 corresponding to the location of the steering pushers 24. FIGS. 4A and 4B show the pairs of signals obtained for clockwise and anticlockwise rotation of the sleeve 4 relative to the housing 20 respectively. It can therefore be seen that the relative position of the irregular pulse 54 obtained from each Hall effect sensor 52 can also indicate the direction of rotation of the sleeve 4.

Figure 2:
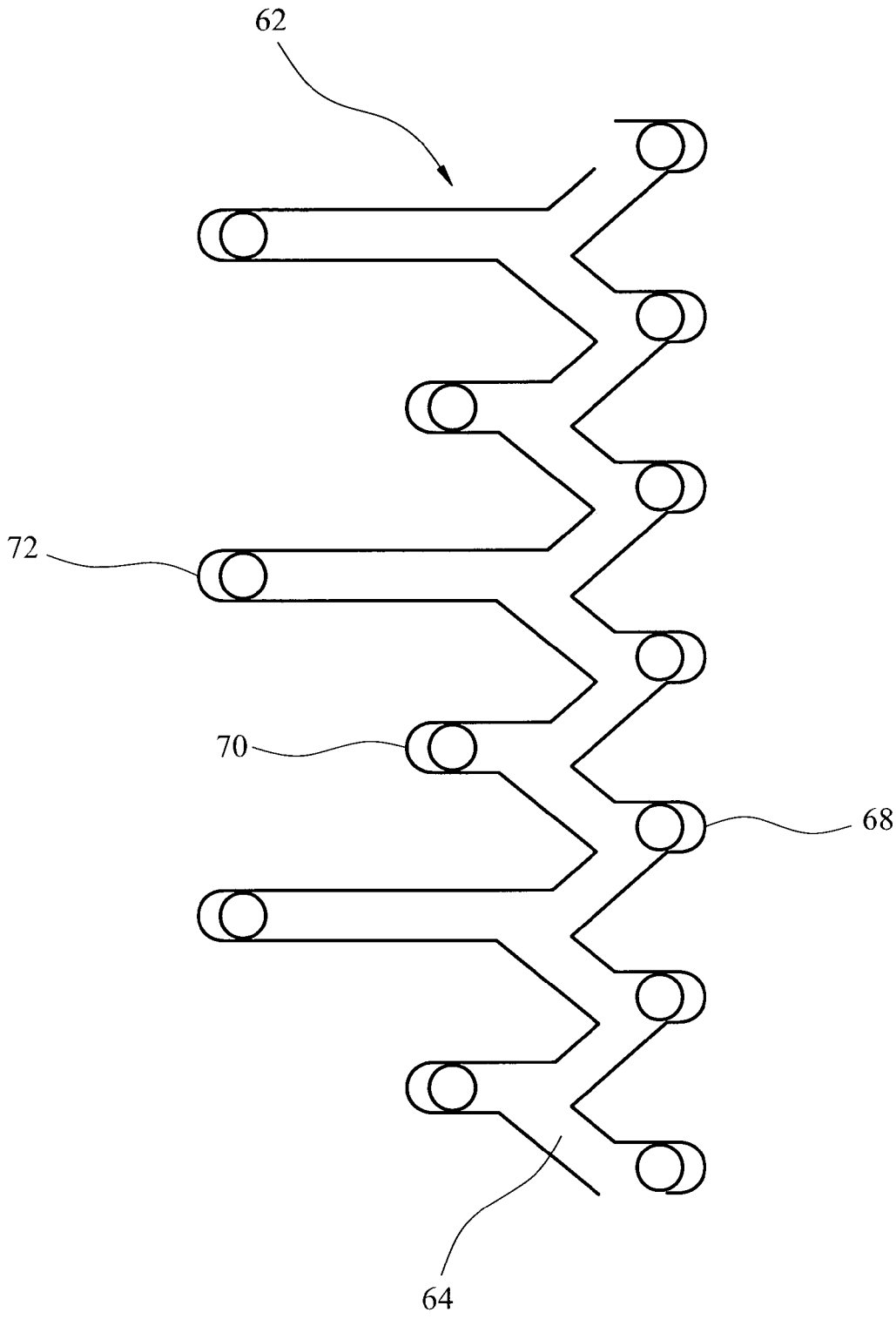
FIG. 2 is an opened out view of a guide means of the tool of FIGS. 1A to 1G.
Figure 3:
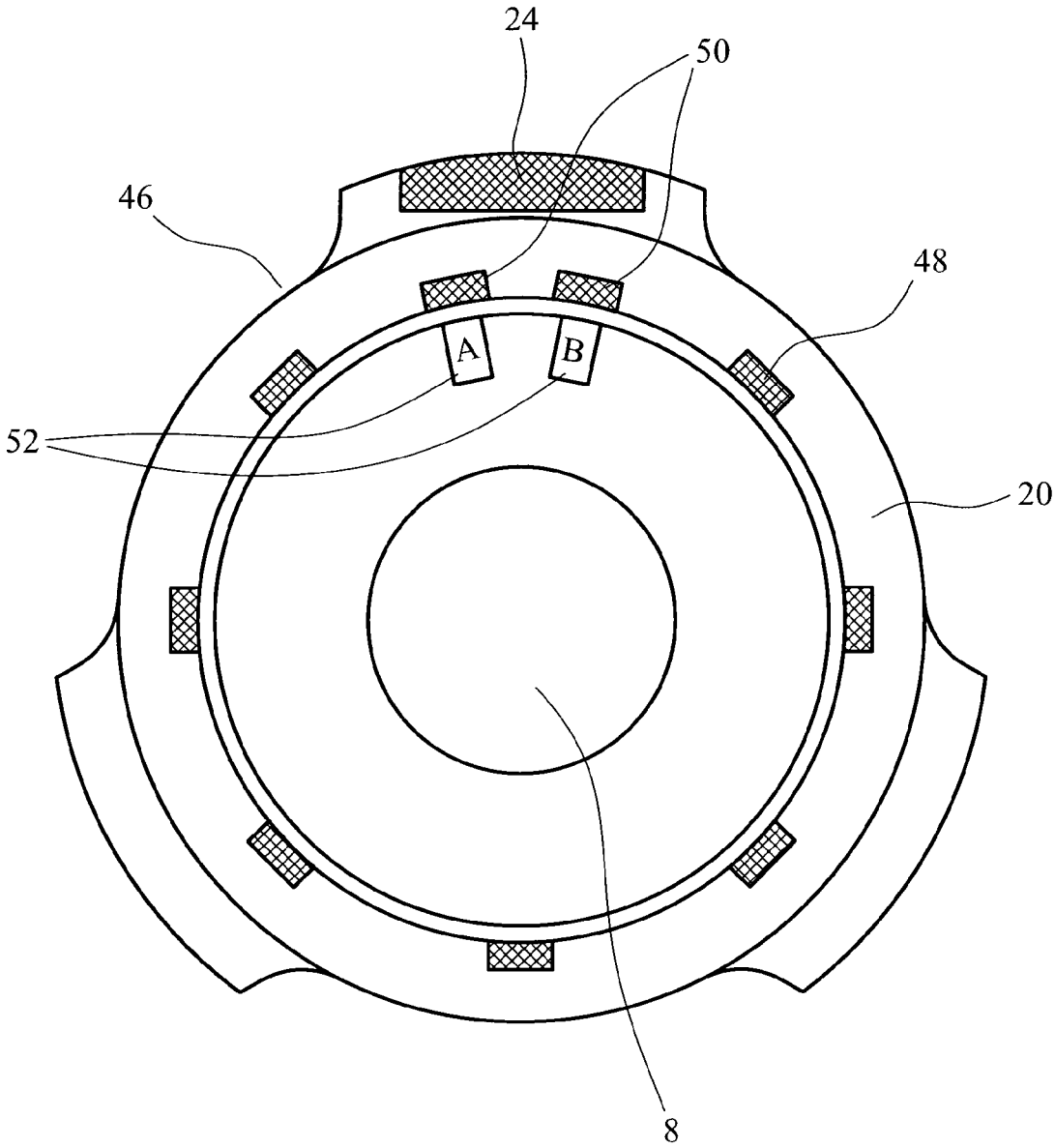
FIG. 3 is an axial cross sectional view of an orientation sensor of the tool of FIGS. 1A to 1G.

A piston 56 is slidably mounted in a piston housing 5 which forms part of the hollow sleeve 4 and has a series of holes 58 in its wall for allowing drilling fluid to pass out of the hollow passage 8 through the piston 56 into the pressure chamber 22 when the holes 58 are aligned with fluid ports 60 when the piston 56 is in its lowermost position in the housing 20. The piston 56 is connected to the piston housing 5 by means of a guide portion 62 formed in the external surface of the piston 56. The guide portion 62 is shown in more detail in FIG. 2 and has a continuous groove 64 around its circumference engaging a set of guide pins 66 on the piston housing 5, and a series of first 68, second 70 and third 72 slots extend from the continuous groove 64. The piston 56 is urged in the direction of arrow A in FIG. 1C by means of a compression spring 74, so that when no drilling fluid pressure is applied, the guide pins 66 are urged into engagement with the first slots 68 by the compression spring 74.

In order to activate the tool 2 in its straight drilling mode, as shown in FIG. 1C, the pressurised drilling fluid is passed down the bore 8 of the piston housing 5. Before the fluid pressure is applied, the guide pins 66 engage alternate first slots 68 of the guide portion 62 under the action of the compression spring 74. When the fluid pressure is applied, the fluid pressure moves the piston 56 in a direction opposite to arrow A in FIG. 1C against the action of the compression spring 74, to cause the guide pins 66 to move from the first slots 68 along the groove to engage the second slots 70. This then enables the piston 56 to move a small distance along the piston housing 5, and cause an end 63 of the piston 56 to abut a slotted shoulder 65 on a lower end 67 of the piston housing 5 to protect the guide pins 66 from shear damage. The piston 56 will move down and bottom out on its nose at the lower end onto ledges created by milling on the lower end of the lower section of the piston housing 5. In this position, the holes 58 in the piston do not communicate with the fluid ports 60 leading to the pressure chamber 22, and pressurised fluid therefore does not enter the pressure chamber 22. As a result, the steering pushers 24 remain retracted into the housing 20 by means of the springs 28, while drag pushers 76 are urged out of the housing 20 by means of springs 78 to engage the borehole wall, as shown in more detail in FIG. 1G. At the same time, the clutch pins 30 are urged by the springs 34 towards and remain in engagement with the slot 32 in the piston housing 5 so that the outer housing 20 rotates with the sleeve 4.

In order to switch the tool 2 into its directional drilling mode, the fluid pressure is then switched off, as a result of which the piston 56 is moved in the direction of arrow A in FIG. 1C under the action of the compression spring 74 to bring the guide pins 66 into engagement with alternate first slots 68 following the second slots 70, as opposed to preceding the second slots 70. When the fluid pressure is again applied, the piston 56 is urged in direction opposite to that of arrow A in FIG. 1C against the action of the compression spring 74 to cause the pins 66 to move along the groove 64 into engagement with the third slots 72. As a result, the piston 56 can then travel further along the piston housing 5 until a shoulder 69 of milled slots on the lower end of the piston 56 abuts slotted shoulder 65 on the lower section 67 of the piston housing 5 to bring the holes 58 in the piston wall into communication with the fluid ports 60. The piston 56 will be moved downwards twice the distance it was moved to activate the tool 2 in the straight drilling mode, as the milled profile on the nose of the piston 56 will now pass by the ledges in the bore of the piston housing 5. This allows pressurised drilling fluid to enter the pressure chamber 22 and urge the steering pushers 24 outwards of the housing 20 against the action of the springs 28. At the same time, the clutch pins 30 are urged out of engagement with the slot 32 in the piston housing 5, as a result of which the sleeve 4 can rotate relative to the housing 20. The steering pushers 24 are urged outwardly into engagement with the wall of the borehole, which causes a deviation in the path of the drilling apparatus. At the same time, drilling fluid can leak out of the pressure chamber 22 through the flow restrictors 36, 38, as a result of which there is a pressure drop which can be detected at the surface or by an MWD tool. This therefore provides an indication that the tool 2 is in the directional drilling mode.

In order to switch the tool 2 back to the straight drilling mode, the fluid pressure is turned off, as a result of which the piston 56 is urged by the compression spring 74 along the bore of the piston housing 5 to bring the guide pins 66 into engagement with the alternate first slots 68 following the third slots 72 and preceding the second slots 70. As a result, the holes 58 in the wall of the piston 56 are no longer in communication with the fluid ports 60, as a result of which the steering pushers 24 and clutch pins 30 are urged inwardly by means of the springs 28, 34 respectively. On application of the fluid pressure again, the piston 56 moves against the action of the spring 74 to bring the pins 66 into engagement with the second slots 70.

Each time the piston 56 moves up and down it will rotate 30 deg each time in the same direction during at least part of the axial travel. The rotation of the piston 56 is the means required to produce the end result of the piston 56 either stopping with 55 or 110 mm travel. 55 mm travel does not result in the holes 58 in the piston 56 aligning with the fluid ports 60 holes in the piston housing 5 while 110 mm produces alignment of these two sets of holes 58, 60 and so part of the flow being diverted into the pressure chamber 22. The sequence of the flow going on and off can infinitely result in the flow, either not being diverted, or being diverted each time. This thus means that the state of the tool 2 will either be straight or directional with each alternate switching on and off of the rig pumps. The flow can then be varied up and down at will when the valve is in the first, closed position and the valve will stay closed to the annulus as it always is when there is no flow. If the flow is stopped, and then started a second time, the valve piston 56 will travel 110 mm and the valve will open to the pressure chamber 22, between the inner and outer assemblies. When open, a high minimum flow is required to keep it from re-closing off the side ports and in this state, the piston 56 requires a small bore nozzle to be mounted in it. It has been calculated that approximately a 1¼" should be sufficient in most cases but the size will vary with large variations in the flow rate and the mud density.

Figure 6:
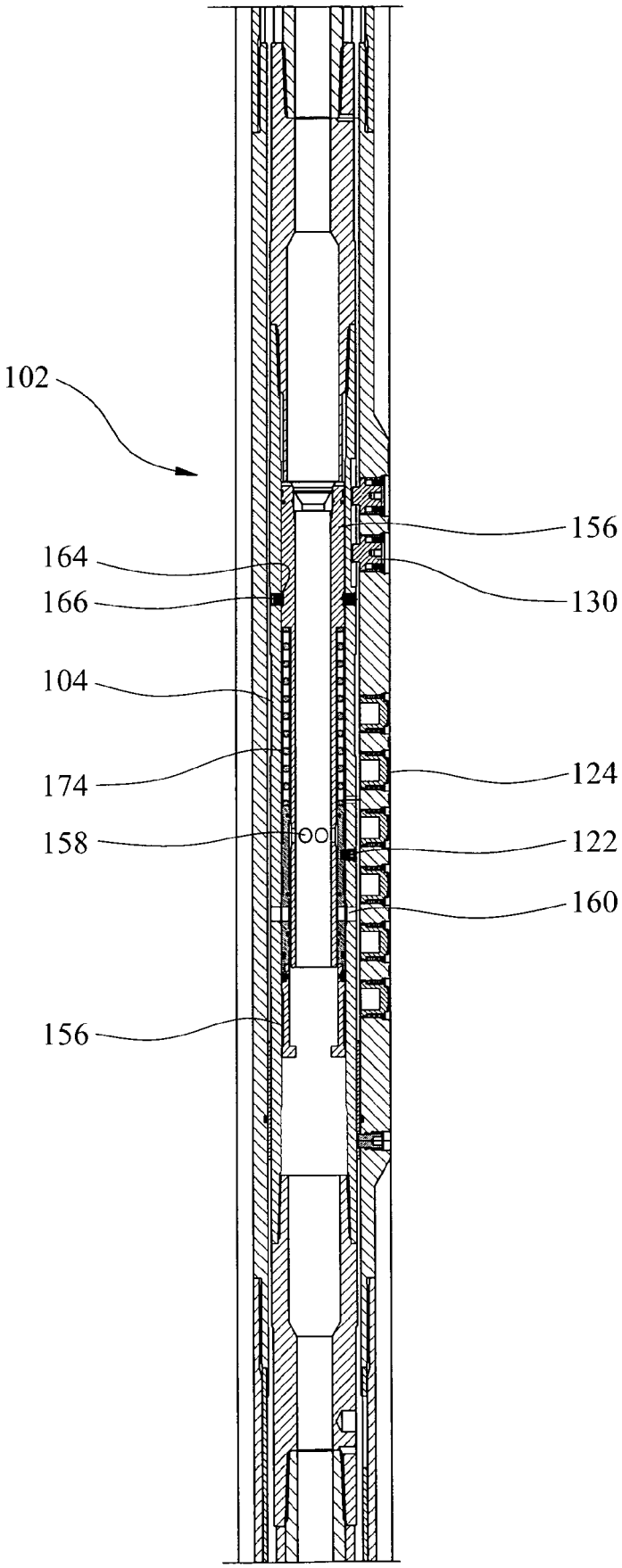
FIG. 6 is a cross sectional view of part of a tool of a second embodiment of the invention.

FIG. 6 shows part of a tool of a second embodiment of the invention in which parts common to the embodiment of FIGS. 1A to 1G are denoted by like reference numerals but increased by 100. The tool 102 of FIG. 6 has a simple up and down piston 156, where no helical travel relative to the sleeve 104 takes place and so there is no axial ball bearing assembly and no helical slotting on the outside of the head of the piston 156. There is a turned groove 164 on the head of the piston 156 into which a spring-loaded detent pin 166 sits when the valve formed by the piston 156 is in the closed position. The pin 166 acts in conjunction with a coil spring and seal friction to stop the piston 156 being driven downwards with mud flow. The angle on the side of the groove or the design of the nose of the pin 166 can be altered to vary the force required to allow the piston 156 to move downwards. The piston 156 is held in the upward location and so the valve is closed to the pressure chamber 122 by a coil spring 174, but there is also a spring-loaded pin detent mechanism.

Figure 7:
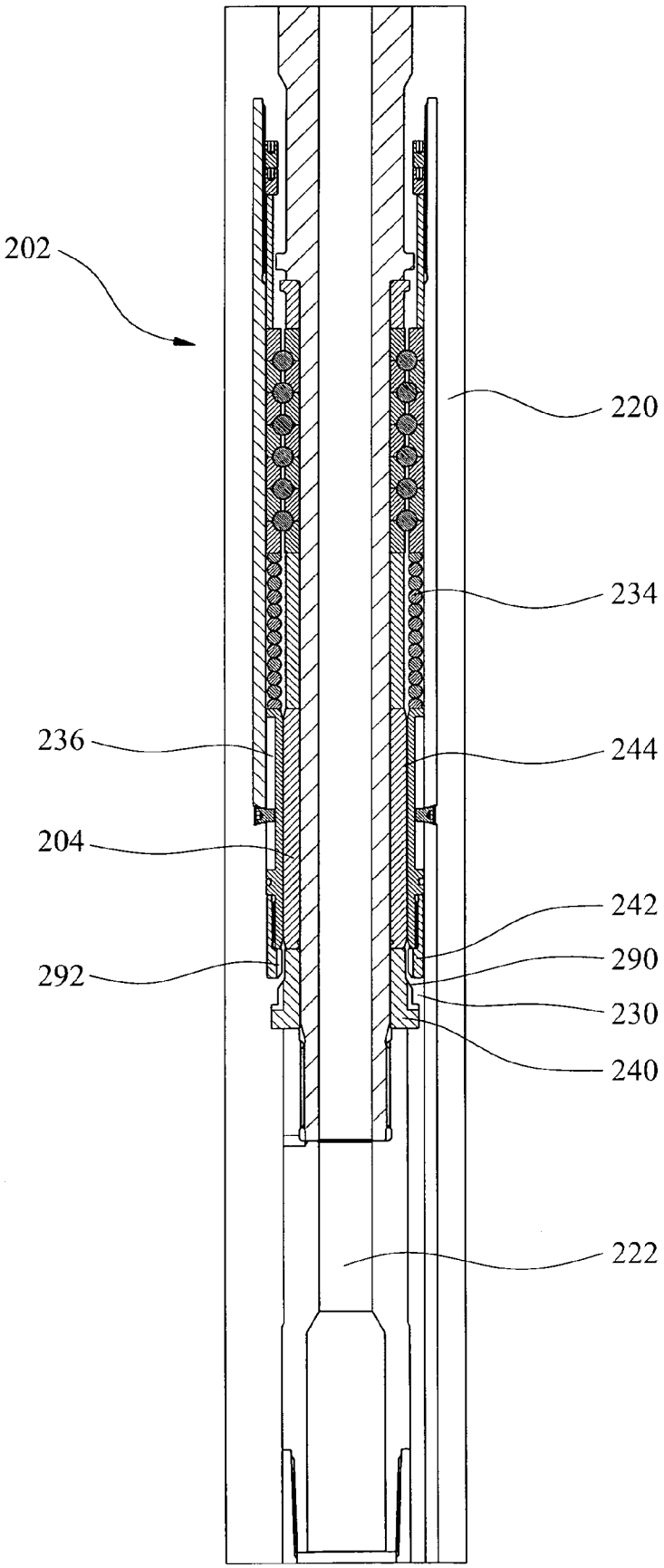
FIG. 7 is a cross sectional view of part of a rotary steerable tool of a third embodiment of the present invention.
Figure 8:
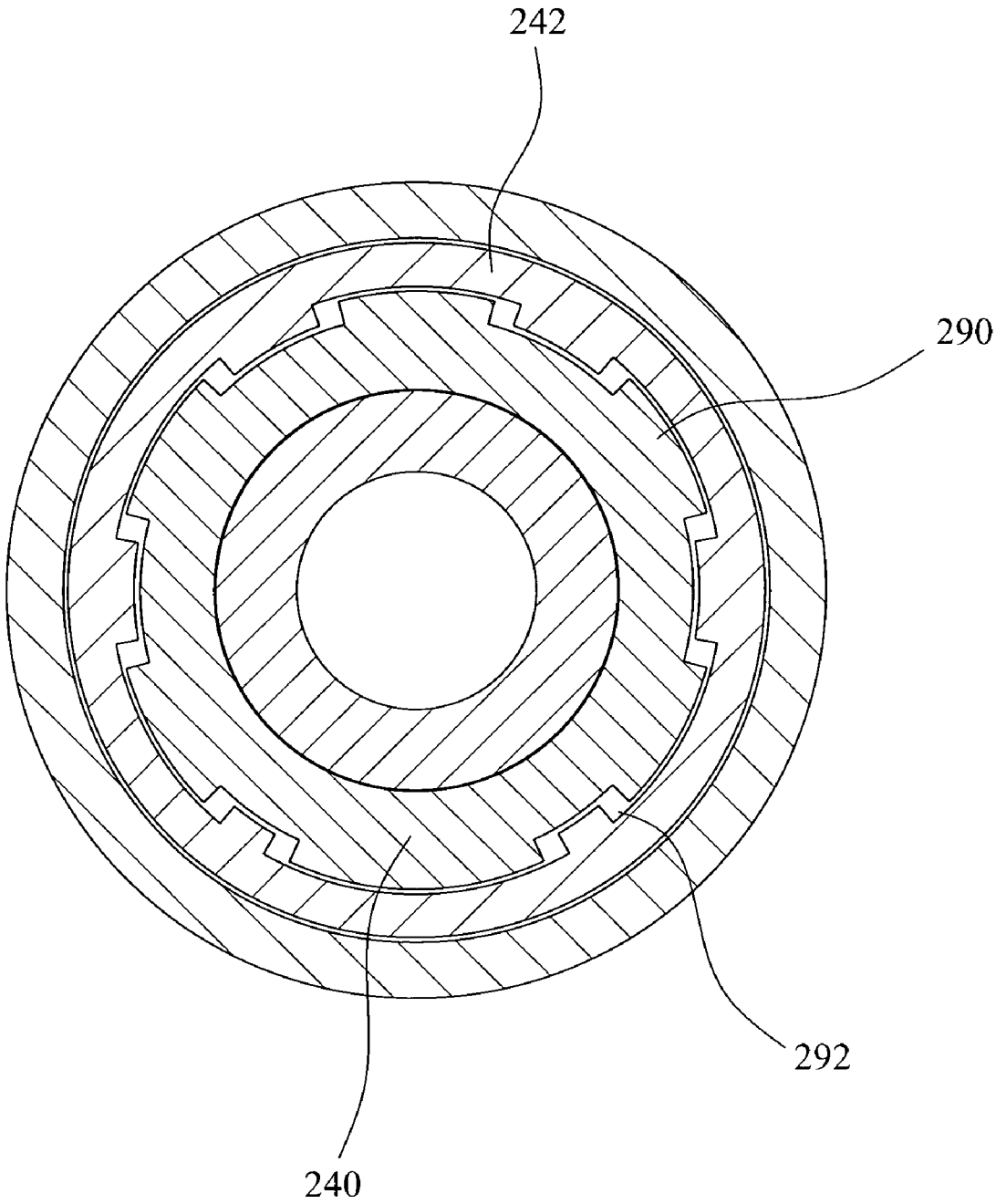
FIG. 8 is an end view of the rotary steerable tool of FIG. 7.

A further embodiment of the invention is shown in FIG. 7, and parts common to the embodiment of FIGS. 1A to 1G are denoted by like reference numerals but increased by 200. The tool 202 has a clutch 230 combined with the upper flow restrictor 236. The clutch 230 consists of engaging teeth 290, 292 formed on end surfaces of the inner 240 and outer 242 cylindrical members respectively, which form the upper flow restrictor 236 having gap 244. In the straight drilling mode, the outer clutch member 242 is biased by means of compression spring 234 into engagement with the inner clutch member 240 so that the teeth 290, 292 engage each other and cause the housing 220 to rotate with the sleeve 204. In the directional drilling mode, however, the outer clutch member 242 is urged by means of drilling fluid in the pressure chamber 222 out of engagement with the inner clutch member 240 against the action of the compression spring 274 so that the sleeve 204 can rotate relative to the housing 220. FIG. 8 shows an end view of the two clutch drive rings 240, 242 engaged around the drive shaft 204. The drive teeth 290, 292 are very thick to cope with high wear levels due to working in the mud environment.

It will be appreciated by person skilled in the art that the above embodiments have been described by way of example only, and not in any limitative sense, and that various alterations and modifications are possible without departure from the scope of the invention as defined by the appended claims. For example, the guide portion 62 having groove 64 and slots 68, 70, 72 shown in FIG. 2 could be provided on a guide ring instead of milled directly into the piston 56. Also, the steering pushers 24 can be provided with rollers to produce lower axial drag of the borehole assembly when the tool 2 in the directional drilling mode. In addition, the flow restrictors 36, 38 can be replaced by labyrinth seal assemblies.

The invention claimed is:

1. A rotary steerable tool adapted to be mounted in a downhole drilling apparatus for adjusting the direction of drilling of the apparatus, the rotary steerable tool comprising:

a tubular outer housing;

at least one steering pusher slidably mounted to the housing for movement between an extended position, in which the steering pusher engages a wall of a borehole formed by the drilling apparatus, and a withdrawn position, in which the steering pusher does not engage the wall of the borehole;

a tubular sleeve mounted inside the housing and adapted to be connected at first and second ends thereof to a drill string to transmit rotary drive to a drilling bit, wherein the sleeve defines a passage for passage of drilling fluid to the drilling bit;

a pressure chamber defined between the sleeve and the housing and communicating with at least one of said steering pushers for enabling the steering pusher to move from the withdrawn to the extended position thereof; and a piston slidably mounted in the tubular sleeve and adapted to be moved by predetermined changes in drilling fluid pressure between a first axial position, in which the interior of the sleeve communicates directly with the pressure chamber to cause at least one of said steering pushers to move to the extended position thereof to engage the wall of the borehole and adjust the direction of drilling of the drilling apparatus by bending the drilling apparatus, and a second axial position, in which the interior of the sleeve does not communicate directly with the pressure chamber to prevent each of the said steering pushers from moving to the extended position thereof.

2. A tool according to claim 1, further comprising:

a guide portion on one of said piston and said sleeve defining a guide track, wherein the guide track has at least one first guide slot, for engaging guide pins positioned on the other side of said piston and said sleeve to retain the piston in the first axial position thereof when drilling fluid pressure is increased;

at least one second guide slot for engaging the guide pins to retain the piston in the second axial position thereof when drilling fluid pressure is increased; and a first spring for urging the piston away from said first and second axial positions.

3. A tool according to claim 2, wherein the guide track has at least one third guide slot arranged such that said first spring urges the piston into a third axial position thereof when drilling fluid pressure is reduced below a first predetermined level.

4. A tool according to claim 3, wherein the first, second and third guide slots are interconnected such that repeated application of drilling fluid pressure above a second predetermined level causes the piston to move alternately into the first and second axial positions thereof.

5. A tool according to claim 2, wherein the guide track comprises at least one continuous groove around the circumference of the guide portion, and said first, second and third guide slots extend from said groove, and said guide pins engage said guide track such that axial movement of said piston between said first and said third axial positions, and between said second and said third axial positions, causes the or each pin to move along said groove.

6. A tool according to claim 1, further comprising a clutch for releasably coupling the housing to the sleeve for rotation therewith.

7. A tool according to claim 6, wherein the clutch comprises:

a first hollow clutch member mounted to one of said housing and said tubular sleeve and having a plurality of protrusions arranged around an end surface thereof;

a second clutch member mounted to the other of said housing and said sleeve and having a plurality of recesses for engaging said protrusions; and a third spring for urging said first and second clutch members into an engaging position in which the protrusions and recesses engage each other to prevent relative rotation of said housing and said sleeve, wherein said first and second clutch members are adapted to be disengaged from each other when the interior of the sleeve communicates directly with said pressure chamber.

8. A tool according to claim 6, wherein the clutch comprises at least one clutch pin communicating with said pressure chamber and slidably mounted to said housing and axially displaced from the or each said steering pusher, wherein at least one said clutch pin is adapted to releasably engage said tubular sleeve.

9. A tool according to claim 1, further comprising a second spring for biasing at least one said clutch pin into engagement with said sleeve.

10. A tool according to claim 1, further comprising flow restrictors arranged at each end of said pressure chamber to restrict flow of fluid out of said pressure chamber to cause a pressure difference between the interior and the exterior of said pressure chamber.

11. A tool according to claim 10, wherein at least one said flow restrictor comprises an outer member and an inner member arranged inside said outer member such that fluid is caused to flow through a gap between said inner and outer members.

12. A tool according to claim 10, wherein at least one said flow restrictor comprises a labyrinth assembly.

13. A tool according to claim 11, wherein at least one of said first and second clutch members is integral with said inner member and the other of said first and second clutch members is integral with said outer member.

14. A tool according to claim 1, further comprising an orientation sensor for indicating the orientation of the housing relative to the tubular sleeve.

15. A tool according to claim 14, wherein the orientation sensor comprises at least one magnet non-rotatably mounted relative to one of said housing and said sleeve, and at least one magnetic sensor non-rotatably mounted to the other of said housing and said sleeve.

16. A tool according to claim 15, wherein at least one said magnetic sensor is a Hall effect sensor.

17. At tool according to claim 15, further comprising a plurality of said magnets, wherein not all of said magnets are equiangularly spaced around the axis of rotation of said sleeve relative to said housing.

18. A tool according to claim 15, further comprising a plurality of said magnetic sensors, wherein not all of said sensors are equiangularly spaced around the axis of rotation of said sleeve relative to said housing.

19. A tool according to claim 1, wherein at least one said steering pusher is adapted to be selectively disabled.

20. A tool according to claim 1, wherein at least one said steering pusher is removable and slidably mounted in a passage in said housing by retention device and is adapted to be outwardly removed from said passage by removal of said retention device.

21. A tool according to claim 1, further comprising a third spring for urging at least one said steering pusher towards the withdrawn position.

22. A tool according to claim 1, further comprising at least one drag pusher adapted to protrude from said outer housing to engage the wall of the borehole.

23. A tool according to claim 22, further comprising a fourth spring for urging at least one said drag pusher out of said housing.

24. A method of operating a rotary steerable tool according to claim 1, the method comprising applying drive to a drive shaft of a drilling apparatus incorporating the tool to drive a drilling bit of the drilling apparatus.

25. A method according to claim 24, further comprising adjusting the direction of drilling of the drilling apparatus by moving said piston from said second axial position to said first axial position.

26. A method according to claim 24, wherein at least one said pusher piston is used to apply a direct side force to the drilling bit.

* * * * *